US006712219B2

(12) United States Patent
Kobayashi et al.

(10) Patent No.: US 6,712,219 B2
(45) Date of Patent: Mar. 30, 2004

(54) BILL RECEIVING AND DISPENSING DEVICE

(75) Inventors: Satoru Kobayashi, Gunma (JP); Yukihiro Nemoto, Gunma (JP); Takashi Okada, Gunma (JP)

(73) Assignee: Oki Electric Industry Co, Ltd., Tokyo (JP)

( * ) Notice: Subject to any disclaimer, the term of this patent is extended or adjusted under 35 U.S.C. 154(b) by 74 days.

(21) Appl. No.: 09/942,963

(22) Filed: Aug. 31, 2001

(65) Prior Publication Data

US 2002/0060400 A1 May 23, 2002

(30) Foreign Application Priority Data

Sep. 5, 2000 (JP) ..... 2000-269273

(51) Int. Cl.[7] ..... B65H 1/00

(52) U.S. Cl. ..... 209/534; 902/12; 902/13; 221/197

(58) Field of Search ..... 902/12, 13; 209/534, 209/900; 271/162, 163, 164, 145; 221/287, 197

(56) References Cited

U.S. PATENT DOCUMENTS 4,659,008 A * 4/1987 Howett et al. ..... 232/43.3
4,704,061 A * 11/1987 Peebles ..... 414/405
4,775,783 A * 10/1988 Sasaki et al. ..... 235/379
5,313,050 A * 5/1994 Hiroki et al. ..... 235/379
5,655,763 A * 8/1997 Gerlier ..... 271/162
5,804,804 A * 9/1998 Fukatsu et al. ..... 235/379
6,006,209 A * 12/1999 Takeuchi et al. ..... 705/40
6,293,540 B1 * 9/2001 Kovacs ..... 271/162
6,454,163 B2 * 9/2002 Peebles et al. ..... 235/379

FOREIGN PATENT DOCUMENTS

JP 04188292 A * 7/1992 ..... G07D/9/00

* cited by examiner

*Primary Examiner*—Donald P. Walsh
*Assistant Examiner*—Joseph Rodriguez
(74) *Attorney, Agent, or Firm*—Rabin & Berdo, P.C.

(57) ABSTRACT

A bill receiving and dispensing device cooperates with a bill cassette, when the bill receiving and dispensing device is replenished with bills or when bills are collected from it, in such a manner that cash is not exposed to the public eye. At the time of replenishment of bills, the bill cassette, in which a fixed number of sheets of bills are accommodated, is received at an inlet/outlet opening of the bill receiving and dispensing device, and the bills within the bill cassette are inserted into the device by a manual operation. The inserted bills are accommodated in a bill accommodation box based on the result of determinations made in a discriminating portion. At the time of collecting bills, an empty bill cassette is received at the inlet/outlet opening and bills are drawn out from the bill accommodation box and are transferred to the bill cassette.

24 Claims, 8 Drawing Sheets

BILL RECEIVING AND DISPENSING DEVICE

BACKGROUND OF THE INVENTION

1. Field of the Invention

The present invention relates to a bill receiving and dispensing device incorporated into an automatic teller machine, and particularly to a technique for replenishment, collecting, and changing of bills in a bill receiving and dispensing device.

2. Description of the Related Art

In recent years, automatic teller machines are installed in convenience stores or the like. Customers can easily carry out a deposit or withdrawal transaction, a transfer transaction, and the like using the automatic teller machine without going to any branch offices of a banking facility, which contributes to improvement in convenience.

FIG. 9 is a schematic diagram showing a conventional bill receiving and dispensing device incorporated into such an automatic teller machine. In FIG. 9, reference numeral 51 denotes a housing of the device, and reference numeral 52 denotes a door provided at the front side of the housing 51. Reference numerals 53 and 54 each denote a bill accommodation box for respective types of bills, for example, a bill accommodation tray for 1,000-yen bills and a bill accommodation tray for 10,000-yen bills, in which bills for being received and dispensed are accommodated.

In the above-described structure, when replenishment or collecting of bills for the bill accommodation boxes 53 and 54 is performed, first, locking of the door 52 is released using a special key.

The door 52 is opened and the bill accommodation boxes 53 and 54 are pulled out from the housing 51 toward an operator. Bills for replenishment are supplied in the bill accommodation boxes 53 and 54 and bills for collecting are taken out from the bill accommodation boxes 53 and 54. Thereafter, the bill accommodation boxes 53 and 54 are pushed in into the housing 51 and the door 52 is closed and locked.

However, the above-described conventional device has the problem that even in a case of replenishment and collecting of a small amount of bills, it is necessary to open the door of the housing, pull out the bill accommodation boxes, and push in the bill accommodation boxes into the housing after replenishment or collecting of bills, which causes troublesome operation and increases the burden on the operator.

Further, the bill accommodation boxes are pulled out from the front side of the device. Therefore, cash is exposed to the customer's eye in a store such as a convenience store, which is not preferable from the standpoint of security.

SUMMARY OF THE INVENTION

Accordingly, an object of the present invention is to realize a bill receiving and dispensing device which can solve the above-described problems.

In order to achieve the above-described object, the first aspect of the present invention is a bill receiving and dispensing device in which at the time of replenishment of bills, a bill cassette, in which a fixed number of sheets of bills can be accommodated, is set at an inlet/outlet opening, the bills within the bill cassette are inserted into the device, and the inserted bills are accommodated in bill accommodation boxes for respective types of bills.

The second aspect of the present invention is a bill receiving and dispensing device in which at the time of collecting bills, a bill cassette, in which a fixed number of sheets of bills can be accommodated, is set at an inlet/outlet opening and bills drawn out from bill accommodation boxes for respective types of bills, are accommodated in the bill cassette.

The third aspect of the present invention is a bill receiving and dispensing device in which at the time of changing bills, a bill cassette, in which bills to be changed can be accommodated, is set at an inlet/outlet opening, the bills within the bill cassette are inserted into the device, and the inserted bills are accommodated in a corresponding bill accommodation box, and bills drawn out from another bill accommodation box are accommodated in the bill cassette.

DESCRIPTION OF THE PREFERRED EMBODIMENTS

Referring now to the attached drawings, embodiments of a bill receiving and dispensing device according to the present invention will be described.

Figure 1:
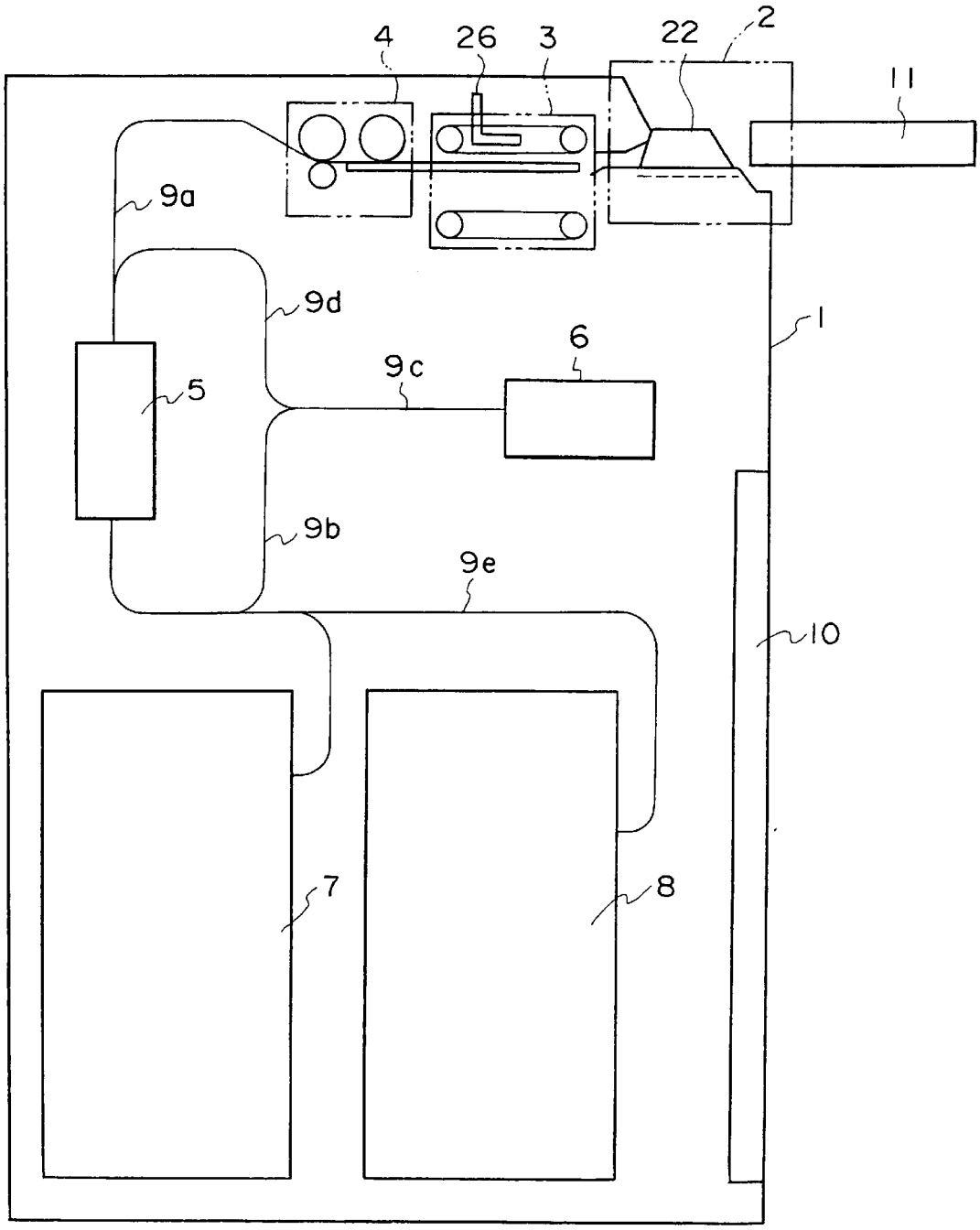
FIG. 1 is a schematic diagram showing a first embodiment of the present invention.
Figure 2:
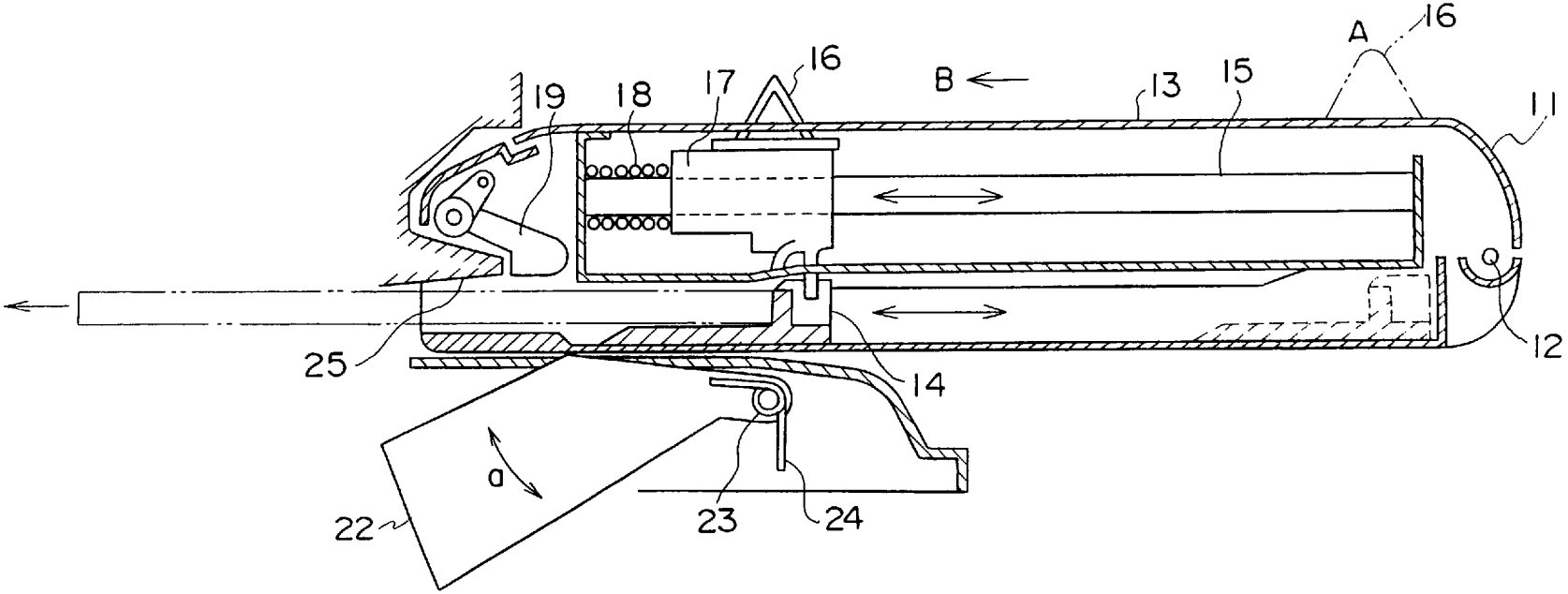
FIG. 2 is a sectional side view of a bill cassette shown in FIG. 1.
Figure 3:
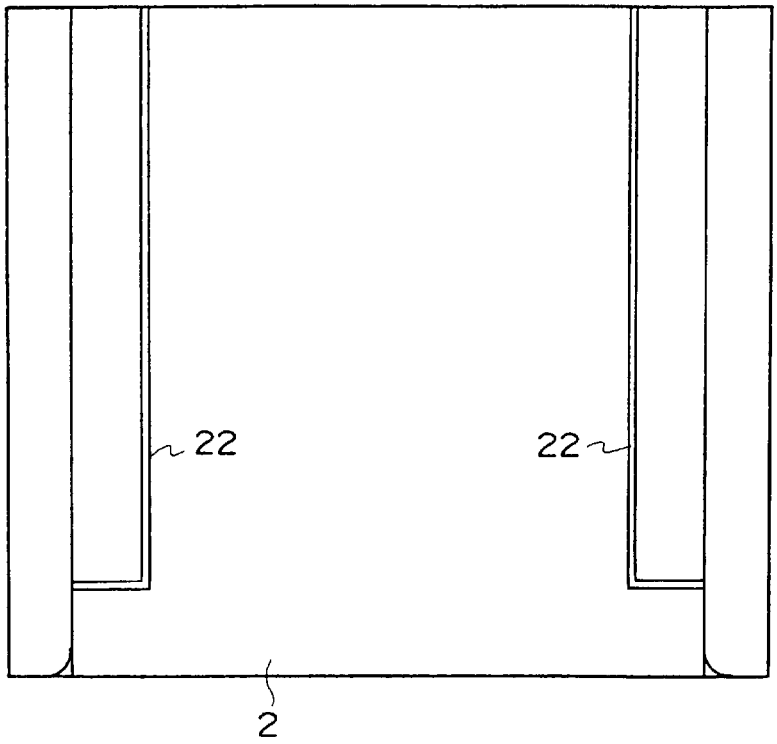
FIG. 3 is a plan view of an inlet/outlet opening shown in FIG. 1.
Figure 4:
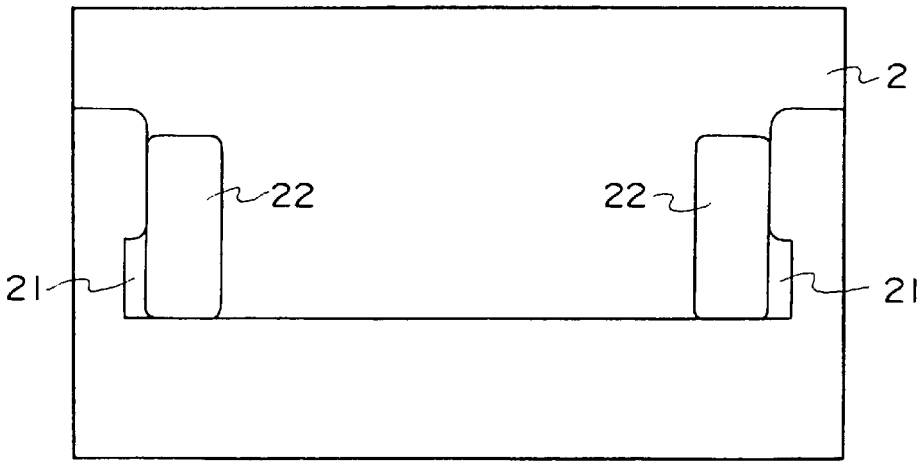
FIG. 4 is a front view of the inlet/outlet opening shown in FIG. 1.

FIG. 1 is a schematic diagram showing a first embodiment of the present invention. FIG. 2 is a sectional side view of a bill cassette used in the first embodiment and FIGS. 3 and 4 are a plan view and a front view, respectively, of an inlet/outlet opening in the first embodiment.

In these drawings, reference numerals 1 and 2 respectively denote a housing body of the device and a bill (note) inlet/outlet opening provided at an upper portion on the front side of the housing body 1.

Reference numerals 3 and 4 are a conveying path unit and a separating and taking-in portion, respectively. The conveying path unit 3 (which will generally be called simply the "conveying path 3" for the rest of this description) and the separating and taking-in portion are provided within the housing body 1.

The conveying path 3 is comprised of an endless belt disposed so that an upper portion and a lower portion of the belt face each other in a vertical direction, and rollers for supporting the belt, and the like. In the conveying path 3, bills are conveyed between the inlet/outlet opening 2 and the separating and taking-in portion 4 while being nipped.

The separating and taking-in portion 4 is formed by a plurality of rollers, and the like. The separating and taking-in portion 4 serves to separate bills, which have been conveyed together by the conveying path 3 from the inlet/outlet opening 2 at the time of receiving (deposit) or replenishment of bills, one by one by cooperative movement of the plurality of rollers, and convey the bills to a discriminating portion, which will be described later. The separating and taking-in portion 4 also serves to take in bills conveyed via the discriminating portion at the time of dispensing (withdrawal) or collecting of bills, and accumulate the bills between facing portions of the belt in the conveying path 3.

Reference numeral 5 denotes the discriminating portion in which the genuineness of each bill, the kind of each bill, and the like are determined, abnormality in conveying of bills is detected, and counting of bills is carried out. Reference numeral 6 denotes a temporary accumulating portion, reference numerals 7 and 8 each denote a bill accommodation box for respective types of bills, and reference numerals 9*a* to 9*e* each denote a conveying path for conveying bills. The separating and taking-in portion 4, the discriminating portion 5, the temporary accumulating portion 6, and the bill accommodation boxes 7 and 8 are connected by the conveying paths 9*a* to 9*e*.

Reference numeral 10 denotes a door provided at the front side of the housing body 1.

Reference numeral 11 denotes a bill cassette. The bill cassette 11 includes an upper cover 13 which opens and closes by swinging around a shaft 12 provided at a rear end of the cassette, as shown in FIG. 2. A tray 14 is provided at a bottom side of the bill cassette 11 so as to be movable in forward and backward directions, and bills are placed in the cassette 11 with the upper cover 13 opened, and set on the tray 14.

A guide shaft 15 is supported along forward and backward directions at the inner side of the upper cover 13, and a moving body 17 having a knob 16 is mounted on the guide shaft 15. The knob 16 protrudes outside of the upper cover 13 and is operated by operator's fingers or the like.

Further, the moving body 17 is formed so as to be engageable with the rear end of the tray 14 when the upper cover 13 is closed. A compression spring 18 is provided at a leading end of the guide shaft 15 so as to return the knob 16 with the moving body 17 to an initial position A.

Moreover, a swingable lid body 19 which closes an inlet/outlet opening for bills is provided at the leading end of the bill cassette 11.

The lid body 19 is locked by a mechanism (not shown) when the bill cassette 11 is not set at the inlet/outlet opening 2. When the bill cassette 11 is inserted into the inlet/outlet opening 2, locking is released. Then, when the bill cassette 11 is pulled out, the lid body 19 is locked again.

Locking can be set by a key in the state in which the upper cover 13 is closed.

As shown in FIG. 4, a guide groove 21 and a movable guide 22 are provided at each of both sides of the inlet/outlet opening 2 of the housing body 1. The guide groove 21 guides insertion of the bill cassette 11 and the movable guide 22 guides bills while regulating the position of bills at the inlet/outlet opening 2 at the time of deposit transaction by a customer.

The movable guide 22 is supported so as to swing around a shaft 23 disposed at one end thereof as shown in FIG. 2, and is urged by a torsion spring 24 so as to protrude from the inlet/outlet opening 2. When the bill cassette 11 is inserted into the inlet/outlet opening 2, the movable guide 22 is pushed by the bill cassette 11 and swings downward so as to retreat from the inlet/outlet opening 2.

Further, a protrusion 25 is formed at the front side of the inlet/outlet opening 2. When the bill cassette 11 is inserted and set in the inlet/outlet opening 2, the protrusion 25 is provided so as to push to open the lid body 19 located at the leading end of the bill cassette 11. A push-in member 26 is disposed at the back side of the inlet/outlet opening 2 and is provided so as to push in bills on the conveying path 3 into the bill cassette 11 at the time of collecting or the like of bills.

The push-in member 26 is formed into, for example, a substantially L-shaped configuration, and is movable, by a mechanism (not shown) including a driving source such as a motor, in upward and downward directions and forward and backward directions. During a normal operation, the push-in member 26 is placed in a waiting state at the upper side.

Next, operation of the above-described structure will be described.

Figure 5:
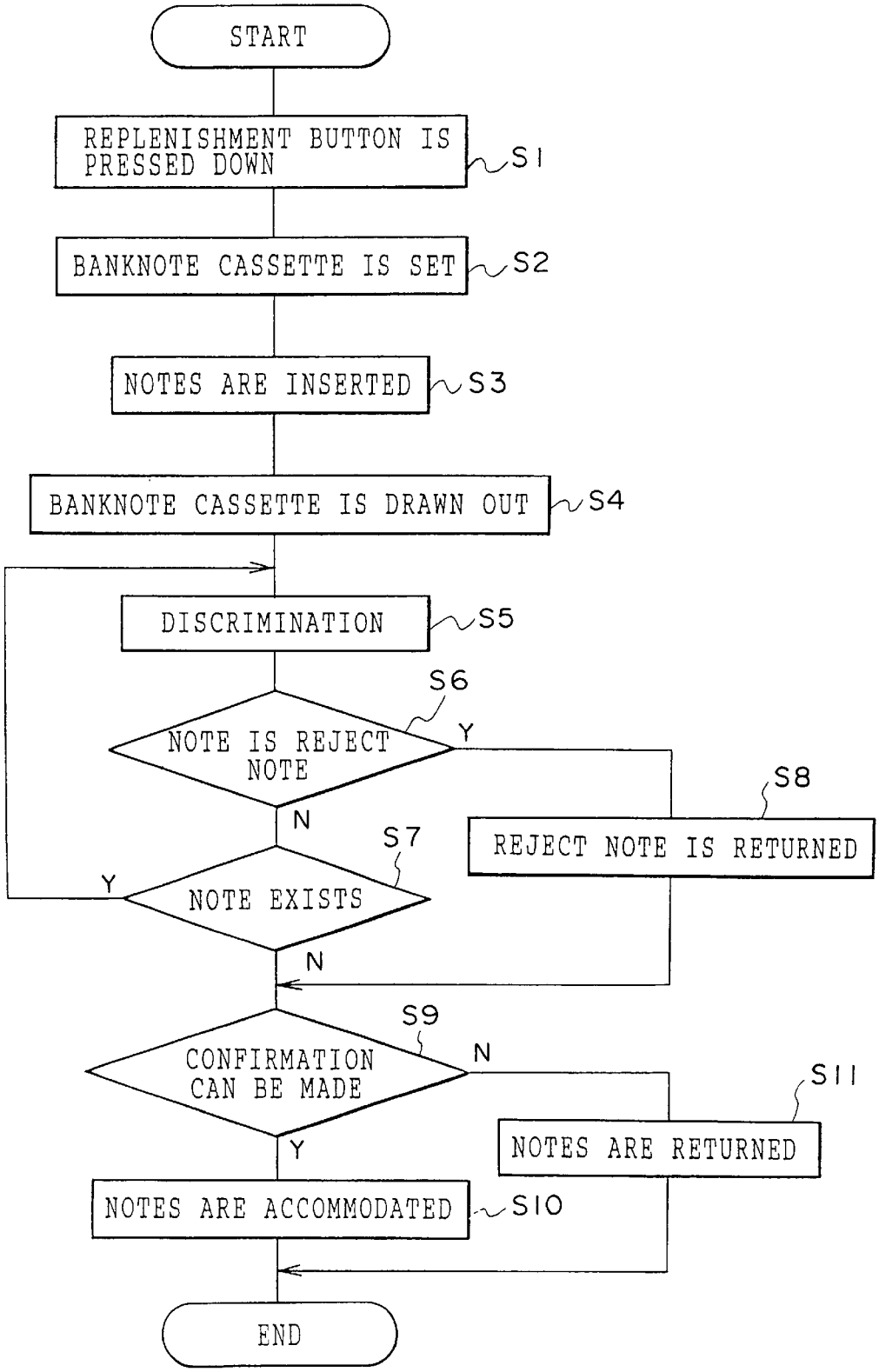
FIG. 5 is a flow chart showing replenishment processing of bills.

FIG. 5 is a flow chart showing bill replenishment processing.

First, when a replenishment button of an operation indicating portion (not shown) is pressed by an operator (S1), a shutter provided at the inlet/outlet opening 2 is opened. Therefore, the bill cassette 11, in which a fixed number of sheets (for example, 50 sheets) are set, is inserted into the inlet/outlet opening 2 along the guide grooves.

Accompanied with the insertion of the bill cassette 11, the movable guides 22 are pushed by the bill cassette 11, and retreat into the housing body 1 in such a manner as to swing around the shaft 23. When the bill cassette 11 is inserted to a predetermined position, the lid body 19 abuts against the protrusion 25 and is pushed to open. As a result, the bill cassette 11 is brought into a state of being set at the inlet/outlet opening 2 (S2).

When the knob 16 is pushed by fingers toward the front side, that is, in the direction indicated by arrow B in FIG. 2 from the above-described state, the moving body 17 moves along the guide shaft 15 integrally with the knob 16, and the tray 14 engaged with the moving body 17 also moves to push the rear end of a bundle of bills set in the cassette 11. Therefore, the bills are inserted into the housing body 1 (S3).

When the leading end of the bundle of bills is detected by a sensor (not shown), the bills are nipped together by the conveying path 3 and conveyed until the leading end thereof reaches the separating and taking-in portion 4.

The position at which the bills have reached the separating and taking-in portion 4, is set as a separation and accumulation position. Thereafter, the conveying path 3 is opened and the bills are released from the state of being nipped thereby.

When the bills thus come out from the bill cassette 11, an instruction for prompting to pull out the bill cassette 11 is displayed in the operation indicating portion. When the operator pulls out the bill cassette 11 from the inlet/outlet opening 2 based on the above-described instruction (S4), this state is detected by a detecting means such as a sensor and a micro-switch (which are both not shown) provided at the inlet/outlet opening 2, and the shutter is closed.

The bills are separated by the separating and taking-in portion 4 one by one and conveyed by the conveying path 9*a* to the discriminating portion 5 in which the genuineness of each bill, the kind thereof, and the like are determined, and abnormality in conveying bills is detected (S5). Based on the determination and the like, it is determined whether each bill is a reject bill (S6).

Bills which are not reject bills, that is, bills which are genuine and of which kinds are determined, are counted and conveyed by the conveying paths 9*b* and 9*c* to the temporary accumulating portion 6 in which the bills are temporarily accumulated.

Subsequently, it is determined whether there is any more bill in the separating and taking-in portion 4 (S7). When there exist bills therein, the bills are conveyed to the discriminating portion 5 and processed in the same manner as described above.

On the other hand, when in the above-described step S5 it is determined that a bill is a reject bill, for example, a false bill (green goods), or that abnormality in conveying bills is detected, the conveying path 9*a* is driven in a reverse direction and the reject bill is conveyed to the separating and taking-in portion 4. Thereafter, the reject bill is taken in by the separating and taking-in portion 4 at the separation and accumulation position.

At this time, when a bill exists at the separation and accumulation position, the reject bill is placed on top of the bill previously located thereat.

Thereafter, the bills located at the separation and accumulation position are nipped by the conveying path 3 and conveyed to the inlet/outlet opening 2. Then, the shutter is opened and the bills are returned to the operator (S8).

Further, the returned bills may be set again in the bill cassette 11 and processed in the above-described steps S1 to S7.

When bills located at the separation and accumulation position are all processed and counting thereof is completed, the result of counting is displayed on an image plane of the operation indicating portion, and it is determined whether the result has been confirmed based on pressing (touching) of a confirmation key or a cancel key on the image plane (S9).

When the operator views the display of the result of counting and presses the confirmation key, it is determined the result has been confirmed and the bills temporarily accumulated in the temporary accumulating portion 6 are conveyed by the conveying paths 9*c* and 9*d* to the discriminating portion 5 in which the kind of each bill is determined.

After the above determination, the bills are conveyed by the conveying path 9*e* and accommodated in the bill accommodation boxes 7 and 8 in accordance with the result of the determination of the kind of each bill. For example, 1,000-yen bills are accommodated in the bill accommodation box 7 and 10,000-yen bills are accommodated in the bill accommodation box 8 (S10), and the processing ends.

On the other hand, when the operator views the display of the result of counting and presses the cancel key, the bills temporarily accumulated in the temporary accumulating portion 6 are conveyed sequentially along the conveying paths 9*c*, 9*b*, and 9*a* and taken in by the separating and taking-in portion 4 and accumulated at the separation and accumulation position. Thereafter, the bills are nipped by the conveying path 3 and conveyed to the inlet/outlet opening 2. Then, the shutter is opened and the bills are returned to the operator, and the processing ends (S11).

Figure 6:
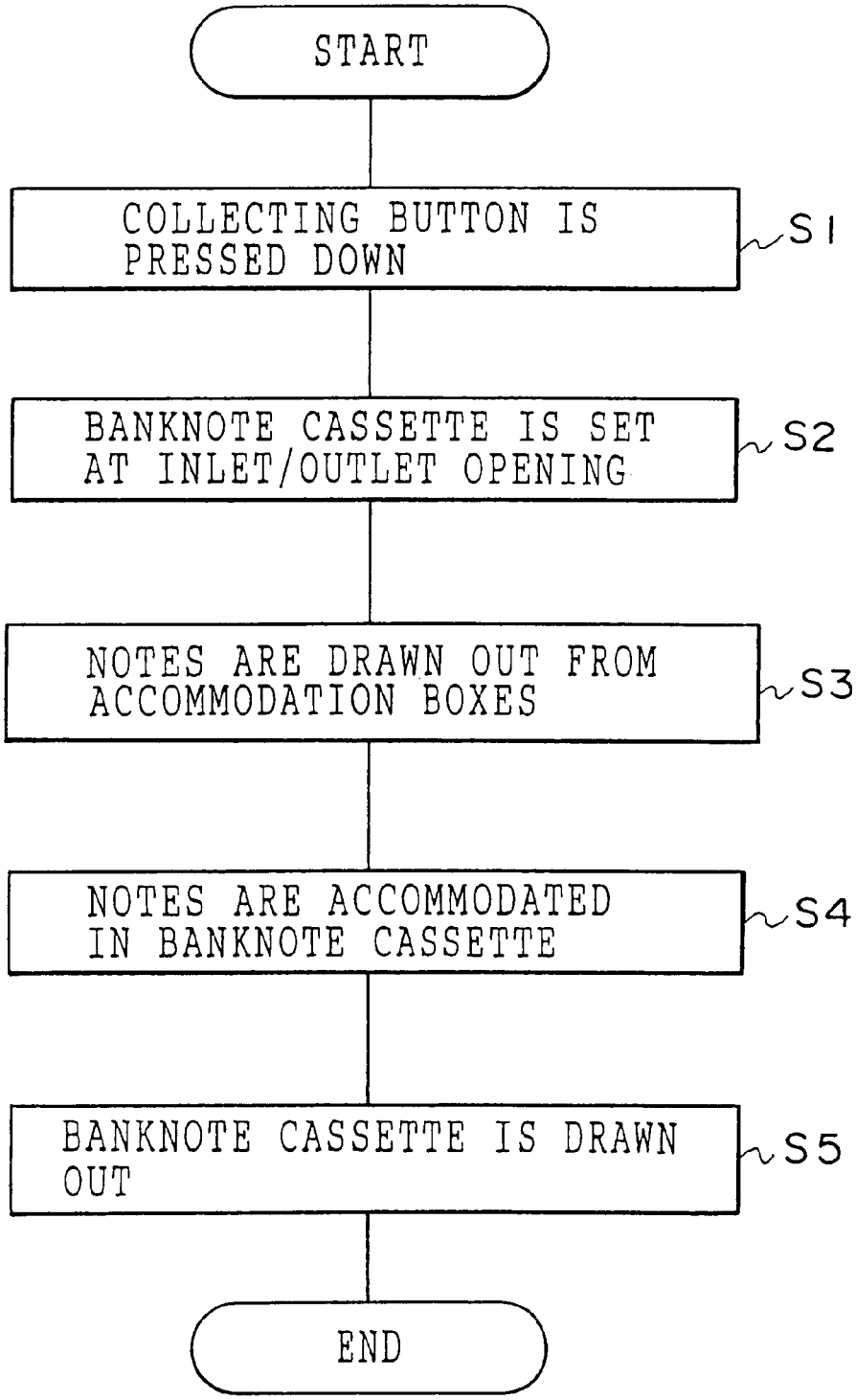
FIG. 6 is a flow chart showing collecting processing of bills.

FIG. 6 is a flow chart showing collecting processing of bills.

First, a collecting button in the operation indicating portion (not shown) is pressed down by the operator (S1).

As a result, the shutter provided at the inlet/outlet opening 2 is opened and the bill cassette 11 in an empty state is inserted into the inlet/outlet opening 2 along the guide grooves.

Accompanied with the insertion of the cassette, the movable guides 22 are pushed by the bill cassette 11 and retreat into the housing body 1 by swinging around the respective shafts 23.

When the bill cassette 11 is inserted to the predetermined position, the lid body 19 abuts against the protrusion 25 and is pushed to open, and the bill cassette 11 is brought into a state of being set at the inlet/outlet opening 2 (S2).

The state in which the bill cassette 11 is set, is detected by a sensor (not shown) provided at the inlet/outlet opening 2.

Subsequently, when the kind of bills is specified by the operator's operating the operation indicating portion, bills corresponding to the specified kind are drawn out from the bill accommodation box 7 or 8 and conveyed by the conveying path 9*e* to the discriminating portion 5 (S3).

After the determination of the kind of each bill, or the like is carried out in the discriminating portion 5, normal bills are conveyed by the conveying path 9*a* to the separating and taking-in portion 4 and taken in and accumulated at the separation and accumulation position.

When a predetermined number (for example, 50) of sheets of bills is accumulated at the separation and accumulation position, the bills are nipped by the conveying path 3 and conveyed to the inlet/outlet opening 2.

The bill cassette 11 is set at the inlet/outlet opening 2, and therefore, the bills are pushed into the cassette 11 by the conveying path 3 from the end of the bill cassette 11. However, the conveying path 3 cannot push the bills further than a predetermined position. The conveying path 3 merely can convey the bills to the predetermined position which is located at right side in FIG. 1. Therefore, when a trailing end of the bills at this time in the direction in which the bills are conveyed, is detected by a sensor (not shown), the push-in member 26 moves downward and further moves the bills toward the inlet/outlet opening 2 (toward the inside of the cassette 1).

Due to the movement of the push-in member 26, the bills are accommodated in a state of being completely pushed into the bill cassette 11 (S4).

Thereafter, the push-in member 26 returns to an original position and an instruction for prompting to remove the bill cassette 11 is displayed in the operation indicating portion. When the bill cassette 11 is drawn out by the operator viewing the instruction (S5), the shutter is closed and the processing ends.

As explained in the bill collecting processing, the bills accumulated at the separation and accumulation position can be accommodated in such a manner as to be fed into the bill cassette 11. Therefore, during the bill replenishment processing explained in FIG. 5, the bill cassette 11 in which reject bills or return bills are accommodated may be drawn out by the operator.

Figure 7:
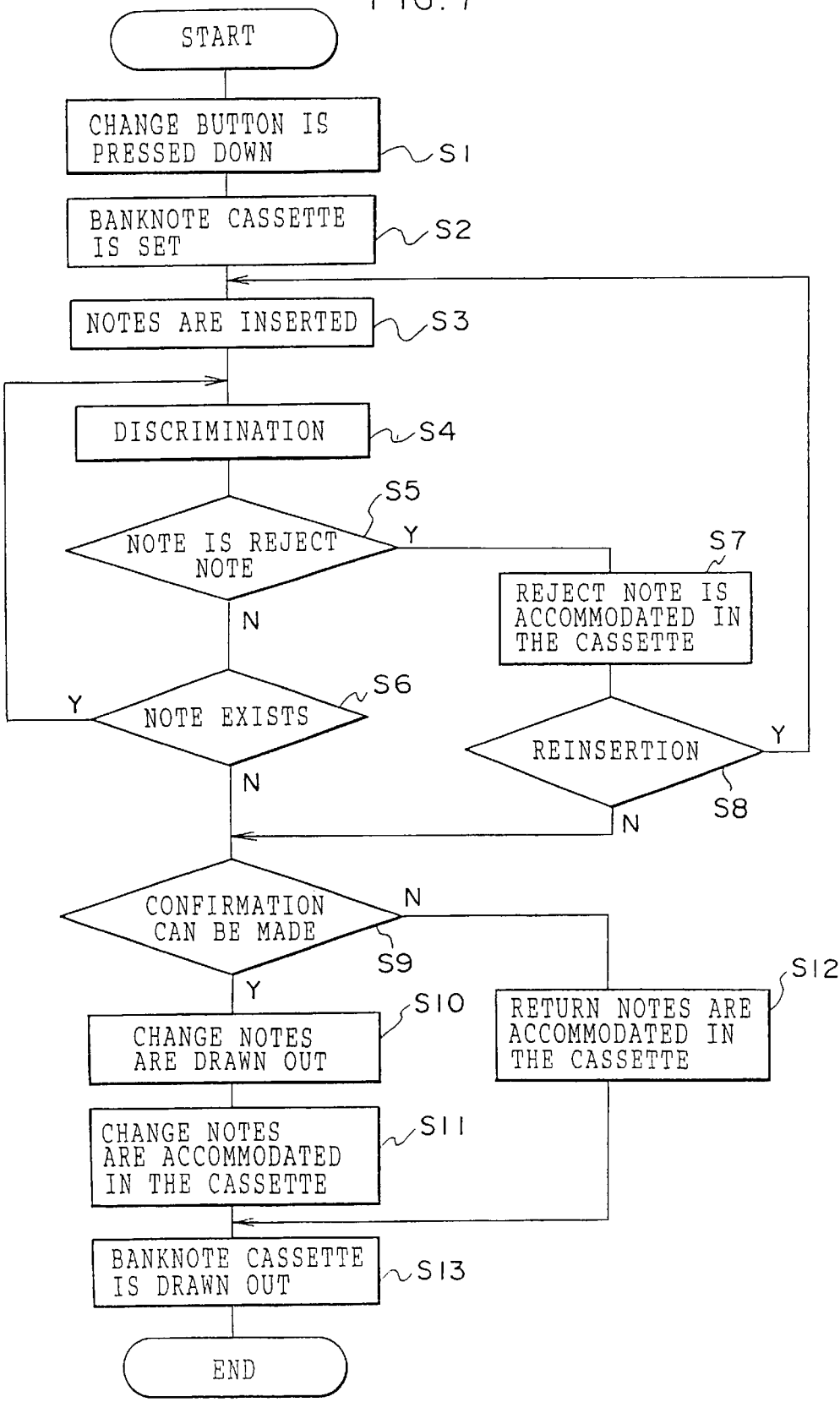
FIG. 7 is a flow chart showing changing processing of bills.

FIG. 7 is a flow chart showing change processing of bills.

First, when a change button of the operation indicating portion (not shown) is pressed down by the operator (S1), the shutter provided at the inlet/outlet opening 2 is opened, and the bill cassette 11 with bills for change are set therein, is inserted into the inlet/outlet opening 2 along the guide grooves.

Accompanied with the insertion of the bill cassette 11, the movable guides 22 are pushed by the bill cassette 11 and retreat into the housing body 1 by swinging around the respective shafts 23.

When the bill cassette 11 is inserted to the predetermined position, the lid body 19 abuts against the protrusion 25 and is pushed to open, and the bill cassette 11 is brought into a state of being set at the inlet/outlet opening 2 (S2).

When the knob 16 is pushed toward the front side, that is, in the direction indicated by arrow B in FIG. 2 from the above-described state, the moving body 17 moves along the guide shaft 15 integrally with the knob 16, and the tray 14 engaged with the moving body 17 also moves to push the rear end of a bundle of bills set in the cassette 11. As a result, the bills are inserted into the housing body (S3).

When a leading end of the bundle of bills in the direction in which the bills are inserted, is detected by a sensor (not shown), the bills are nipped together by the conveying path 3 and conveyed to a position at which the leading end thereof reaches the separating and taking-in portion 4, that is, the separation and accumulation position. Thereafter, the conveying path 3 is opened and the bills are released from being nipped thereby.

Subsequently, the bills are separated one by one by the separating and taking-in portion 4 and conveyed by the conveying path 9*e* to the discriminating portion 5 in which the genuineness of each bill, the kind thereof, and the like are determined, and abnormality in conveying of bills is detected (S4). Based on the result of the determination and the like, it is determined whether each bill is a reject bill (S5).

Bills which are not reject bills, that is, bills which are genuine and of which kind is determined, are counted and conveyed by the conveying path 9*b* and 9*c* to the temporary accumulating portion 6 in which bills are temporarily accumulated.

Thereafter, it is determined whether any bill exists in the separating and taking-in portion 4 (S6). If bills exist therein, the bills are conveyed to the discriminating portion 5, in which the bills are processed in the same manner as described above.

On the other hand, when in the above-described step S5 it is determined that a bill is a reject bill, for example, a false bill (green goods), or that abnormality in conveying bills is detected, the conveying path 9*a* is driven in a reverse direction and the reject bills are conveyed to the separating and taking-in portion 4 and taken in by the separating and taking-in portion 4 at the separation and accumulation position.

At this time, when a bill exists at the separation and accumulation position, the reject bill is placed on top of the bill previously located thereat.

Thereafter, in the same way as in the case of the collecting operation, the bills located at the separation and accumulation position are accommodated in such a manner as to be fed into the bill cassette 11 by the conveying path 3 and the push-in member 26 (S7).

In this case, it is determined by the operator whether the bills accommodated in the bill cassette 11 should be inserted again (S8). When it is determined that the bills should be inserted again, the process returns to step S3 in which the bills are sent out by pushing the knob 15 toward the front side.

When the bills are not reinserted, the bill cassette 11 is once removed from the inlet/outlet opening 2 and bills accommodated in the cassette are taken out therefrom. Thereafter, the bill cassette 11 in an empty state is set again at the inlet/outlet opening 2.

When the bills located at the separation and accumulation position are all processed and counting thereof is completed, the result of counting, the kind of bills for which changing will be made, the number of sheets of bills, and the like are displayed on an image plane of the operation indicating portion. It is determined whether the displayed contents have been confirmed by pressing a confirmation key or a cancel key on the image plane (S9).

When the operator views the above-described display and presses the confirmation key, it is determined that the displayed contents have been confirmed, and the bills temporarily accumulated in the temporary accumulating portion 6 are conveyed to the discriminating portion 5 in which the kind of each bill is determined.

After the above determination, the bills are conveyed by the conveying path 9*e*, and based on the result of the determination of the kind of bills, they are accommodated in the bill accommodation boxes 7 and 8. For example, when 1,000-yen bills are changed to 10,000-yen bills, the 1,000-yen bills are accommodated in the bill accommodation box 7. Further, when 10,000-yen bills are changed to 1,000-yen bills, the 10,000-yen bills are accommodated in the bill accommodation box 8.

Subsequently, the bills are drawn out from the bill accommodation box 7 or 8 and conveyed by the conveying path 9*e* to the discriminating portion 5 (S10).

After the type of each bill and the like are determined in the discriminating portion 5, normal bills are conveyed by the conveying path 9*a* to the separating and taking-in portion 4 and taken in by the separating and taking-in portion 4 and accumulated at the separation and accumulation position.

When bills which are collected by this changing operation are accumulated at the separation and accumulation position, the bills are sent and accommodated in the bill cassette 11 by the conveying path 3 and the push-in member 26 in the same manner as in the case of the collecting operation (S11).

When the operator views the display which shows the result of counting and the like, and presses the cancel key, the bills temporarily accumulated in the temporary accumulating portion 6 are conveyed sequentially along the conveying paths 9*c*, 9*b*, and 9*a*, and taken in by the separating and taking-in portion 4 and accumulated at the separation and accumulation position.

The bills accumulated at the separation and accumulation position are also conveyed to and accommodated in the bill cassette 11 by the conveying path 3 and the push-in member 26 (S12).

Thereafter, an instruction for prompting to remove the bill cassette 11 is displayed in the operation indicating portion. When the bill cassette 11 is pulled out by the operator viewing the above display (S13), the shutter is closed and the processing ends.

Figure 8:
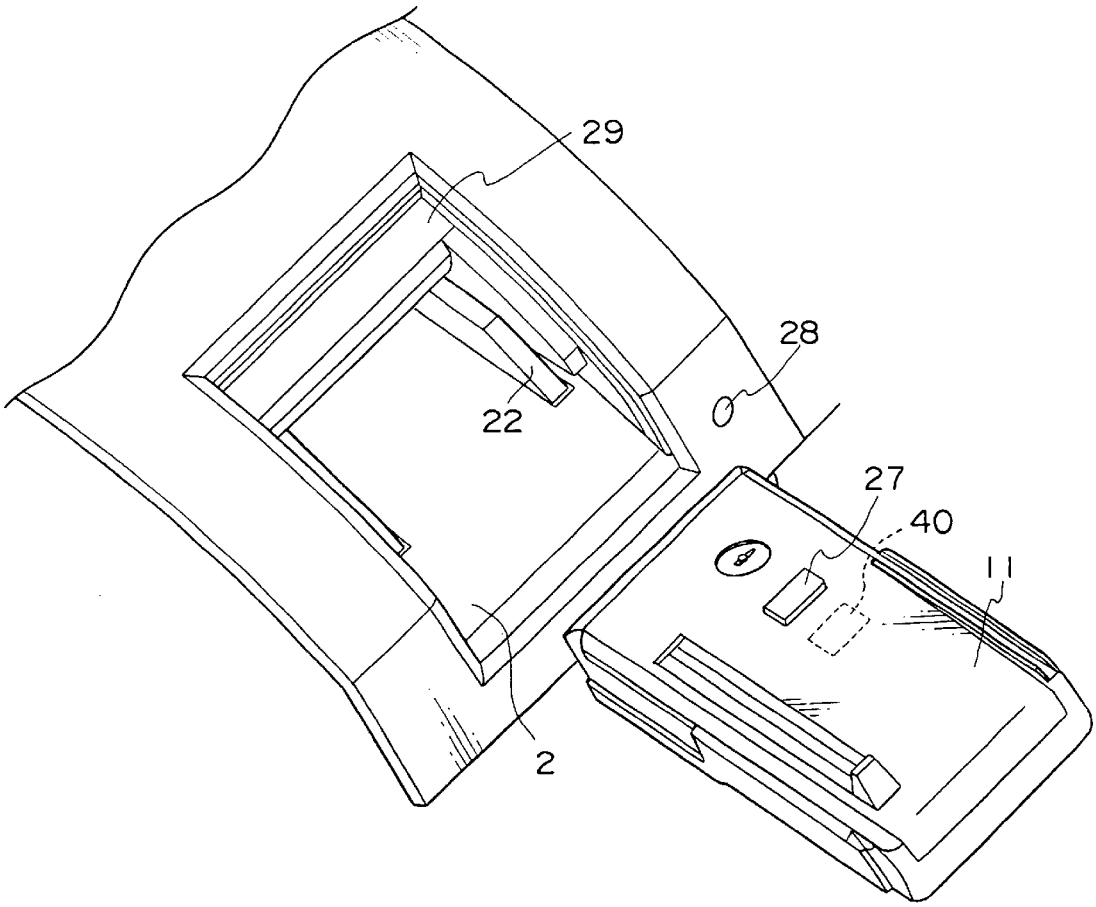
FIG. 8 is a perspective view of a principal portion showing a second embodiment of the present invention.
Figure 9:
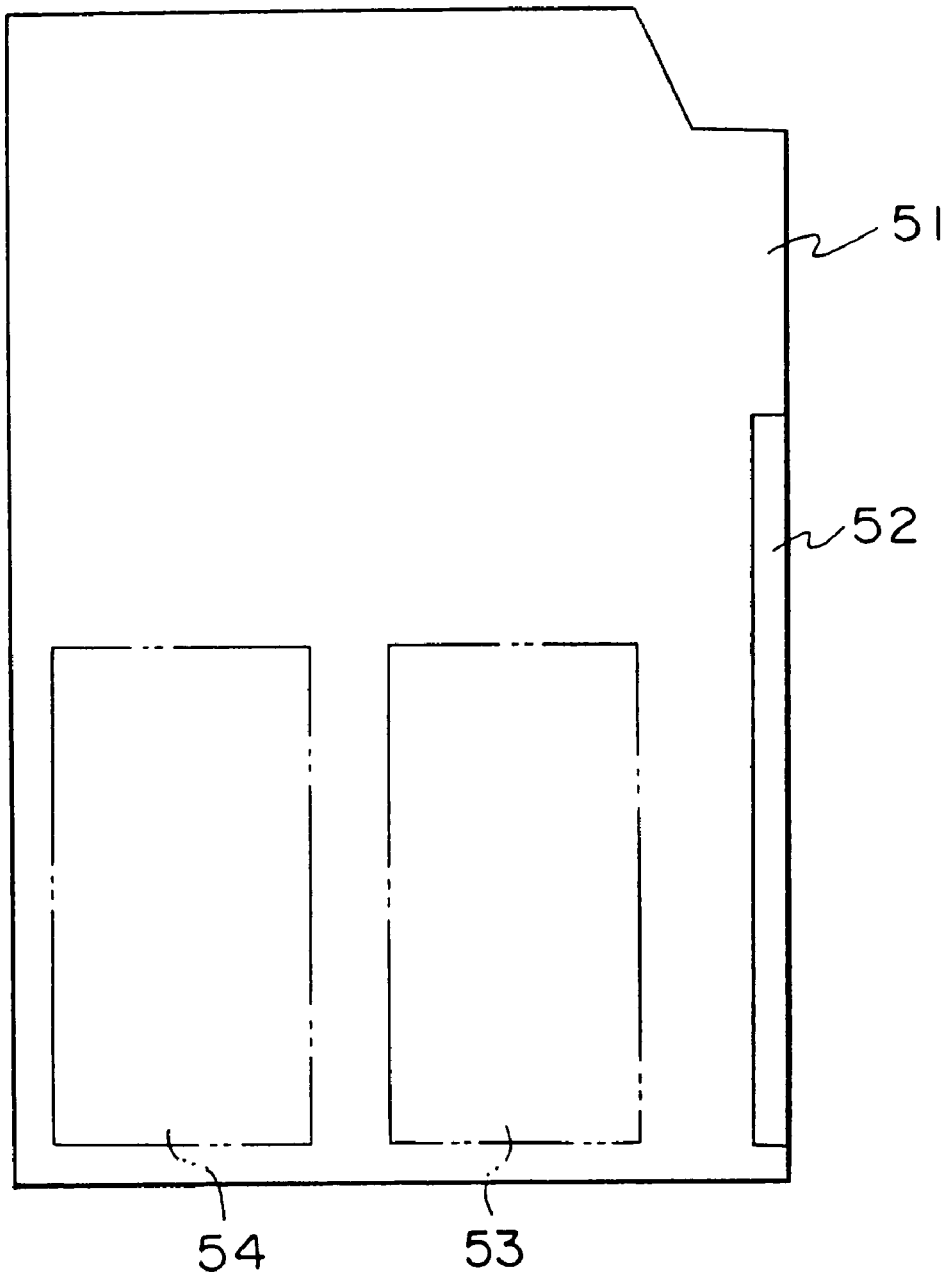
FIG. 9 is a schematic diagram showing a conventional device.

FIG. 8 is a perspective view of a principal portion of a second embodiment of the present invention.

In the second embodiment, a shutter operating button 27 and a signal generating means for generating a signal are provided in the bill cassette 11 and a receiving means 28 for receiving a signal is provided at the inlet/outlet opening 2 of the device. In the case of replenishment, collecting, and changing of bills, the shutter operating button 27 of the bill cassette 11 is pressed down to generate a signal from the signal generating means, and the signal is received by the receiving means 28 to allow opening of the shutter 29. According to this structure, an opening operation of the shutter can be performed promptly.

In the above-described embodiments, the bills within the bill cassette 11 are inserted into the device by operating the knob 16 with fingers or the like. However, the bills within the bill cassette 11 can also be automatically inserted into the device.

Moreover, the above-described embodiments were each described in a case in which yen bills are processed. The present invention is not limited to the same and can also be applied to a case in which dollar bills or the like are processed.

As described above, in the bill receiving and dispensing device of the present invention, at the time of replenishment of bills, a bill cassette in which a fixed number of sheets of bills are accommodated is set at an inlet/outlet opening, the bills within the bill cassette are inserted into the device by a manual operation, and the inserted bills are accommodated in bill accommodation boxes for respective types of bills. Further, at the time of collecting bills, the bill cassette is set at the inlet/outlet opening and bills drawn out from the bill accommodation boxes are accommodated in the bill cassette.

According to this structure, replenishment and collecting of bills can be carried out without opening the door of the housing body and pulling out the bill accommodation boxes. As a result, it is possible to obtain an effect in that a complicated operation is eliminated to allow reduction of a burden on an operator.

Further, replenishment and collecting of bills are carried out using the bill cassette. Therefore, it is also possible to obtain another effect in that cash is exposed to the public eye and security is thereby excellent.

Moreover, changing can also be carried out by utilizing replenishing and collecting functions using the bill cassette. Therefore, if this bill receiving and dispensing device is installed in convenience stores and the like, it is highly convenient for the staff.

What is claimed is:

1. A bill transfer system, comprising:

a bill cassette accommodating a plurality of bills; and a bill receiving and dispensing device that includes a housing with a front side having an inlet/outlet opening, and bill accommodation boxes in the housing for respective types of bills, the bill cassette being received at the inlet/outlet opening at a time of replenishment of bills and the bills within the cassette being inserted into the bill receiving and dispensing device in a bundled state, at least some of the inserted bills then being conveyed to one of the bill accommodation boxes.

2. A bill receiving transfer system according to claim 1, wherein the bill cassette comprises a cover which can be opened and closed, a knob which is slidable with respect to the cover, and a tray on which bills are set, and when the cover is closed, the knob is engaged with the tray, and the tray is moved by sliding the knob thereby to insert the bills into the bill receiving and dispensing device.

3. A bill transfer system according to claim 1, wherein the bill dispensing and receiving device further comprises guide grooves for guiding insertion of the bill cassette at the inlet/outlet opening, and movable guides which retreat into the bill receiving and dispensing device due to the bill cassette being received at the inlet/outlet opening, and which protrude at the inlet/outlet opening to guide bills to be inserted into the inlet/outlet opening or to be drawn out from the inlet/outlet opening when the bill cassette is not received at the inlet/outlet opening.

4. A bill transfer system according to claim 1, wherein a push-in member by which bills are pushed from the bill receiving and dispensing device into the bill cassette.

5. A bill transfer system according to claim 1, wherein the bill cassette further comprises a signal generating section for generating a signal, and the bill receiving and dispensing device further comprises a shutter at the inlet/outlet opening, and a signal receiving section for receiving the signal, and before the bill cassette is received at the inlet/outlet opening, the signal generated from the signal generating section is received by the signal receiving section, and the shutter provided is opened.

6. A bill transfer system according to claim 1, wherein the bill cassette has a bill gate and a lid member that is swingably dispensed at the bill gate so as to close the bill gate, wherein the bill receiving and dispensing device has a protrusion, and wherein the protrusion presses and swings the lid member to allow opening of the bill gate when the bill cassette is received at the inlet/outlet opening and inserted to a predetermined position.

7. A bill transfer system according to claim 1, wherein the inlet/outlet opening is an opening through which customers deposit bills into the bill receiving and dispensing device or withdraw bill from the bill receiving and dispensing device.

8. A bill transfer system, comprising:

a bill cassette; and a bill receiving and dispensing device that includes a housing with a front side having an inlet/outlet opening, and bill accommodation boxes in the housing for respective types of bills, the bill cassette being received at the inlet/outlet opening at a time of collecting bills and bills being drawn out of one of the bill accommodation boxes, at least some of the drawn-out bills being conveyed to the cassette in a bundled state.

9. A bill transfer system according to claim 8, wherein the bill cassette comprises a cover which can be opened and closed, a knob which is slidable with respect to the cover, and a tray on which bills are set, and when the cover is closed, the knob is engaged with the tray, and the tray is moved by sliding the knob.

10. A bill transfer system according to claim 8, wherein the bill receiving and dispensing device further comprises guide grooves for guiding insertion of the bill cassette at the inlet/outlet opening, and movable guides which retreat into the bill receiving and dispensing device due to the bill cassette being received at the inlet/outlet opening, and which protrude at the inlet/outlet opening to guide bills to be inserted into the inlet/outlet opening or to be drawn out from the inlet/outlet opening when the bill cassette is not received at the inlet/outlet opening.

11. A bill transfer system according to claim 8, wherein the bill receiving and dispensing device further comprises a push-in member by which bills are pushed from the bill receiving and dispensing device into the bill cassette.

12. A bill transfer system according to claim 8, wherein the bill cassette further comprises a signal generating section for generating a signal, and the bill receiving and dispensing device further comprises a shutter at the inlet/outlet opening, a signal receiving section for receiving the signal, and before the bill cassette is received at the inlet/outlet opening, the signal generated from the signal generating section is received by the signal receiving section, and the shutter provided is opened.

13. A bill transfer system according to claim 8, wherein the bill cassette has a bill gate and a lid member that is swingably disposed at the bill gate of the bill cassette so as to close the bill gate, wherein the bill receiving and dispensing device has a protrusion, and wherein the protrusion presses and swings the lid member to allow opening of the bill gate when the bill cassette is received at the inlet/outlet opening and inserted to a predetermined position.

14. A bill transfer system according to claim 8, wherein the inlet/outlet opening is an opening through which customers deposit bills into the bill receiving and dispensing device or withdraw bill from the bill receiving and dispensing device.

15. A bill transfer system, comprising:

a bill cassette accommodating a plurality of bills having a predetermined denomination; and a bill receiving and dispensing device that includes a housing with a front side having an inlet/outlet opening, a bill accommodation box in the housing that holds bills of a different denomination, the bill cassette being received at the inlet/outlet opening at a time of changing bills and the bills with the predetermined denomination within the bill cassette being inserted into the bill receiving and dispensing device in a bundled state, and bills of the different denomination being drawn out of the bill accommodation box, wherein at least some of the bills of the predetermined denomination are conveyed to the bill accommodation box and at least some of the bills of the different denomination are conveyed to the cassette.

16. A bill transfer system according to claim 15, wherein the bill cassette comprises a cover which can be opened and closed, a knob which is slidable with respect to the cover, and a tray on which bills having the predetermined denomination are set prior to the time of changing bills, and when the cover is closed, the knob is engaged with the tray, and the tray is moved by sliding the knob thereby to insert the bills having the predetermined denomination into the bill receiving and dispensing device.

17. A bill transfer system according to claim 15, wherein the bill receiving and dispensing device further comprises guide grooves for guiding insertion of the bill cassette are provided at the inlet/outlet opening, and movable guides which retreat into the bill receiving and dispensing device due to the bill cassette being received at the inlet/outlet opening, and which protrude at the inlet/outlet opening to guide bills to be inserted into the inlet/outlet opening or to be drawn out from the inlet/outlet opening when the bill cassette is not received at the inlet/outlet opening.

18. A bill transfer system according to claim 15, wherein the bill receiving and dispensing device further comprises a push-in member by which bills are pushed from the bill receiving device into the bill cassette.

19. A bill transfer system according to claim 8, wherein the bill cassette further comprises a signal generating section for generating a signal, and the bill receiving and dispensing device further comprises a shutter at the inlet/outlet opening, and a signal receiving section for receiving the signal, and before the bill cassette is received at the inlet/outlet opening, the signal generated from the signal generating section is received by the signal receiving section, and the shutter is opened.

20. A bill transfer system according to claim 15, wherein the bill cassette has a bill gate and a lid member that is swingably provided at the bill gate of the bill cassette so as to close the bill gate, wherein the bill receiving and dispensing device has a protrusion, and wherein the protrusion presses and swings the lid member to allow opening of the bill gate when the bill cassette is received at the inlet/outlet opening and inserted to a predetermined position.

21. A bill transfer system according to claim 15, wherein the inlet/outlet opening is an opening through which customers deposit bills into the bill receiving and dispensing device or withdraw bill from the bill receiving and dispensing device.

22. A bill receiving and dispensing device configured for use with a bill cassette accommodating a plurality of bills, said bill receiving and dispensing device comprising:

a housing having a front side and an inlet/outlet opening at the front side, bills being received into the housing or dispensed from the housing via the inlet/outlet opening;

bill accommodation boxes for accommodating respective types of bills; and a guide member at the inlet/outlet opening for guiding insertion of the bill cassette to the inlet/outlet opening, wherein the bills are conveyed between the bill receiving and dispensing device and the bill cassette in a bundled state.

23. A bill receiving and dispensing device according to claim 22, wherein bills accommodated in the bill cassette are transferred to one of the accommodation boxes in a bundled state.

24. A bill receiving and dispensing device according to claim 22, wherein bills accommodated in one of the accommodation boxes are transferred to the cassette in a bundled state.

* * * * *